US005332085A

United States Patent [19]

Fraser

[11] Patent Number: 5,332,085

[45] Date of Patent: Jul. 26, 1994

[54] SHIPPING AND DISPLAY CONTAINER FOR LAWN IMPLEMENT

[75] Inventor: Ronald A. Fraser, Chandler, Ariz.

[73] Assignee: Ryobi Outdoor Products, Chandler, Ariz.

[21] Appl. No.: 6,375

[22] Filed: Jan. 19, 1993

[51] Int. Cl.[5] ..... B65D 5/50; B65D 71/08

[52] U.S. Cl. ..... 206/45.14; 206/349; 206/386; 206/485; 206/497; 206/526; 206/597

[58] Field of Search ..... 206/45.14, 485, 349, 206/370, 526, 597, 600, 386, 497; 211/70.6; 53/446, 443, 448

[56] References Cited

U.S. PATENT DOCUMENTS

| | | | |
|---|---|---|---|
| 2,291,645 | 8/1942 | Nordquist | 53/498 |
| 2,727,620 | 12/1955 | Buttery | 206/45.19 |
| 2,752,035 | 6/1956 | Shinoda . | |
| 3,481,453 | 12/1969 | Shreve, III et al. . | |
| 3,570,658 | 3/1971 | Swanberg . | |
| 3,669,253 | 6/1972 | Hanko . | |
| 3,741,380 | 6/1973 | Carney . | |
| 3,747,831 | 7/1973 | Hanson . | |
| 3,747,835 | 7/1973 | Graser . | |
| 3,825,113 | 7/1974 | Kramer et al. | 206/497 |
| 3,874,450 | 4/1975 | Nicholl . | |
| 4,171,050 | 10/1979 | Murray et al. . | |
| 4,247,003 | 1/1981 | Jones . | |
| 4,287,991 | 9/1981 | Donnelly | 206/600 |
| 4,354,598 | 10/1982 | Schillinger . | |
| 4,549,654 | 10/1985 | Tiesman . | |
| 4,848,563 | 7/1989 | Robbins . | |
| 4,915,224 | 4/1990 | Wulf et al. . | |
| 5,048,677 | 9/1991 | Pedracine . | |
| 5,114,002 | 5/1991 | Warner . | |

*Primary Examiner*—Bryon P. Gehman
*Attorney, Agent, or Firm*—Brooks & Kushman

[57] ABSTRACT

A shipping and display container having a generally C-shaped configuration enabling vertical orientation of an elongated lawn implement such that the upper end of the lawn implement is oriented above the implement end. The container allows access to the lawn implement without destruction or manipulation of the shipping and display container. In addition, the lawn implement may be utilized as a handle for carrying both the lawn implement and container. The container has interlocking display surfaces adapted to receive point of sale display graphics while greatly increasing the viewing angle of consumers approaching the container.

20 Claims, 4 Drawing Sheets

SHIPPING AND DISPLAY CONTAINER FOR LAWN IMPLEMENT

TECHNICAL FIELD

The present invention relates to shipping and display cartons and more particularly to a shipping and display container for lawn implements.

BACKGROUND OF THE INVENTION

Outdoor tools such as lawn implements are designed to withstand abuse and feel comfortable in the hands of an operator. This durability and comfort is often the key factor in determining whether or not to purchase the product. Therefore, it is important for consumers to be able to touch and grip the product at the point of sale prior to making the purchase decision.

Traditionally, packages for such products were enclosed in corrugated containers with the consumer having to rely on a picture or description on the outer carton. Consumers interested in obtaining access to the product were forced to open the packaging to test for durability and feel of the product. Such activity by the consumer resulted in a number of opened and/or damaged packages which made subsequent sale difficult. In an attempt to minimize damaged containers, many retailers now take several units completely out of the enclosed cartons to use for display purposes. These display units have frequently sustained damage and theft of the most removable components resulting in a "return to vendor" situation.

In addition to the inability to touch the product without opening conventional packaging, such conventional packaging made carrying the product from the display to the cash register and subsequently to the consumer's destination difficult due to the cumbersome size of the product and its packaging. In addition, traditional packages for lawn implements or the like have been displayed either in a horizontal fashion or in a inverted fashion such that the motor end of the implement is located at the lower end of the package. This horizontal or inverted display of the product does not provide the consumer with the opportunity to view the product in its in-use orientation.

The present invention is directed to improving known shipping and display containers for lawn implements or the like.

SUMMARY OF THE INVENTION

The present invention provides a container for shipping and displaying a lawn implement. The container has a body portion defining an open central region for receiving the lawn implement in an upright orientation. The body portion also has a rear panel and a plurality of side panels, each of the plurality of side panels having a first side section and a second side section. The first side section is oriented generally perpendicular to the rear panel and the second side section is integrally connected to the first side section and folded back toward the rear panel into engagement with one another to provide a display surface. A top portion and a bottom portion are contiguous with the first side panels of the body portion and extend outwardly from the rear panel beyond the first side sections. The bottom is located opposite the top portion for supporting the container in a generally vertical orientation when placed upon a flat horizontal surface. An upper retainer is provided which cooperates with the top portion for removably retaining the upper end of the lawn implement. A lower retainer cooperates with the bottom portion for removably retaining the implement end of the lawn implement. The upper and lower retainer also cooperate with the open central region to enable the lawn implement to be used as a handle for carrying the container.

Another object of the present invention is to provide a system for shipping a plurality of elongated implements. A plurality of shipping containers are provided each having a body portion having a rear panel and a pair of side panels which cooperate with the rear panel to form two triangular tubes when seen in cross section. A top portion and a bottom portion are provided which are contiguous with the side panels in opposed relation such that the top and bottom portions project from the rear panel beyond the side panels. A base is provided which is sized to receive a plurality of shipping containers in a generally vertical orientation such that at least two of the shipping containers are oriented face-to-face such that their respective rear panels are exposed. A lid is provided which is sized to substantially surround the top portions of the same number of shipping containers as received by the base. A wrap is provided which substantially surrounds the lid, the base and the plurality of shipping containers to form an immobile unit.

An object of the present invention is to provide a shipping and display container capable of being displayed in a vertical, in-use orientation.

Another object of the present invention is to provide a shipping and display carton providing the consumer access to the product to use the handle and shaft to carry the container from the on-sale display area to the cash register and ultimately to the consumer's final destination.

A further object of the present invention is to provide a shipping and display container capable of being shipped in combination with a plurality of other shipping and display containers to provide a sturdy and secure shipping unit which protects the product against damage while easily being unpacked and separated from the other shipping and display containers for point of sale display.

Still another object of the present invention is to provide a plurality of billboard panels on the shipping and display container to provide for large angled advertising space easily viewed by consumers as they approach the on-sale display from different angles.

A feature of the present invention is that the container enables the motor end of the lawn implement to be displayed distal from the floor in a vertical orientation.

Another feature of the present invention is the angled billboard surfaces surrounding the lawn implement which are used to attract attention to the product by consumers approaching at different angles.

An advantage of the present invention is allowing consumers access to the product at point of sale display without requiring tampering of the shipping and display container.

A further advantage of the present invention is enabling the handle area of the lawn implement to be utilized in carrying the product thereby avoiding conventional cumbersome movement of such products.

The above objects, features and advantages of the present invention are readily apparent from the following detailed description of the invention when taken in connection with the accompanying drawings.

DETAILED DESCRIPTION OF THE INVENTION

Figure 1:
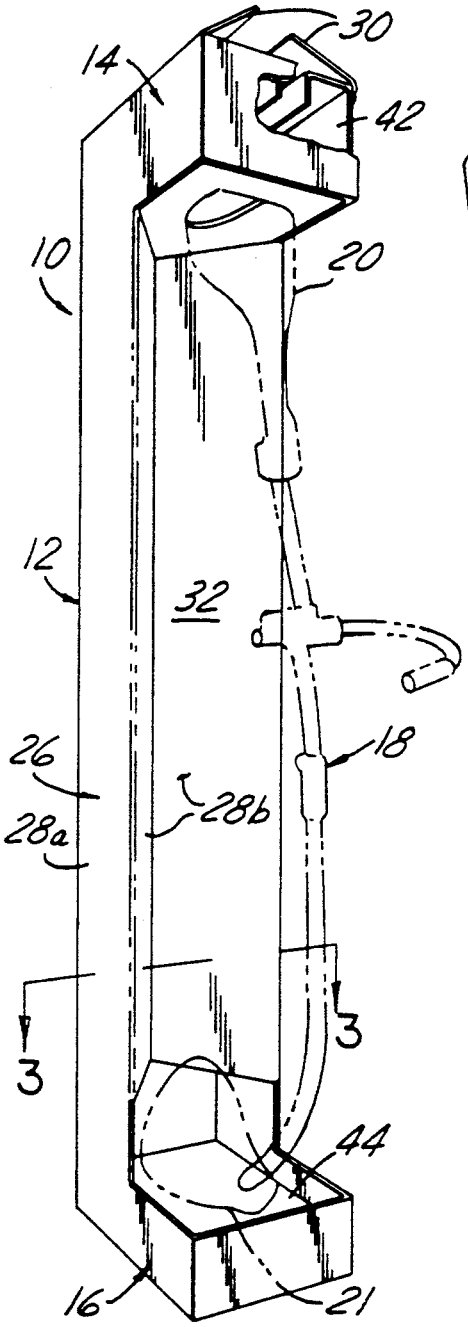
FIG. 1 is a perspective view of the shipping and display container partially cutaway showing the top retainer means and showing the lawn implement contained within the shipping and display container in phantom in accordance with the present invention.

The embodiment illustrated in FIGS. 1 through 7 depicts a shipping and display container 10. The container is formed from a body portion 12, a top portion 14 and a bottom portion 16.

As shown in FIG. 1, the container 10 is intended to be utilized to display an elongated lawn implement, generally indicated at 18, in a generally vertical orientation. In this orientation, an upper end 20 of the lawn implement 18 is located above an implement end 21 of the lawn implement 18. The upper end 20 of the lawn implement 18 in this embodiment contains the motor (whether electric or gasoline) which is considerably heavier than the implement end 21. In order to display the lawn implement 18 in such a manner it is essential that the container 10 be sturdy.

Figure 4:
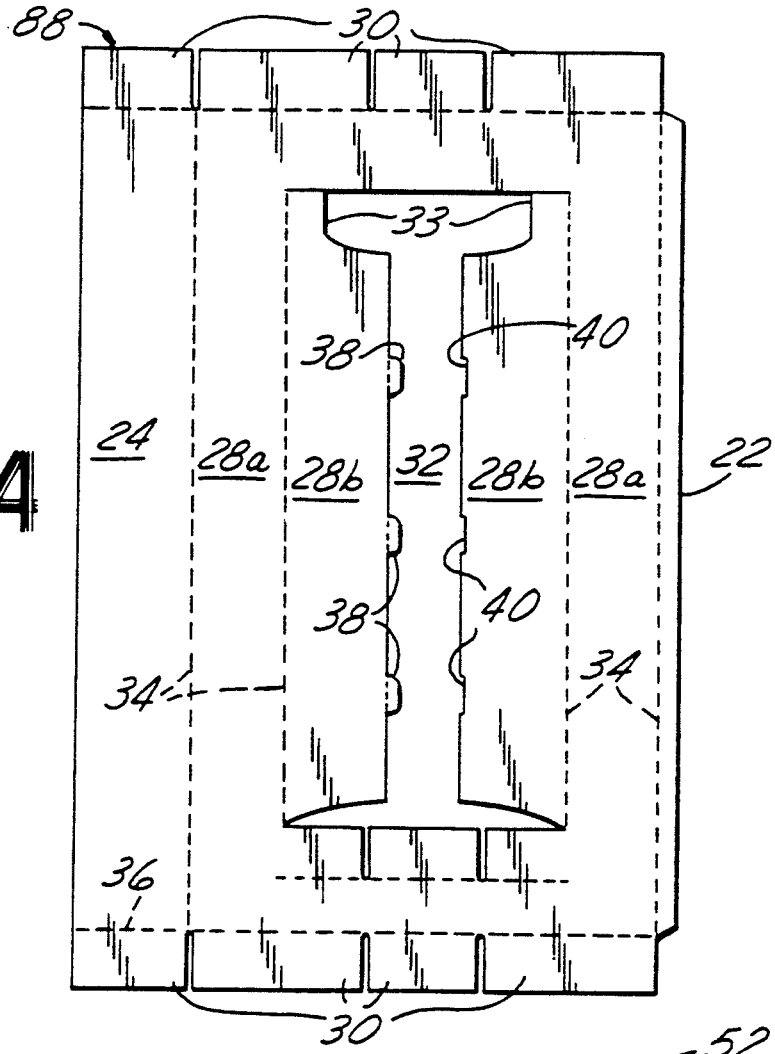
FIG. 4 is a plan view of the blank utilized to form the shipping and display container shown in FIG. 1.

A blank 88 depicted in FIG. 4 and the assembled product shown in FIG. 1 best illustrate the relationship of the elements forming the container 10. The container 10 has a connecting panel 22 which cooperates with a rear panel 24 to form the container 10. Adjacent the rear panel 24 and generally perpendicular thereto are a pair of side panels 26. The side panels 26 each have a first side section 28*a* and a second side section 28*b*. The first side sections 28*a*, in conjunction with segments of top and bottom portions 14 and 16 form, have a generally C-shaped configuration as best seen in FIG. 1. The top portion 14 and the bottom portion 16 are each contiguous with the side panels 26.

As shown in FIGS. 1 and 4, each of the top and bottom portions, 14 and 16, has flaps 30. The top and bottom portions are formed adjacent the side panels 26 extending beyond the first side sections 28*a* such that a face section 31 extends between the side panels 26 generally perpendicular thereto and distal from the rear panel 24. The bottom portion provides a generally flat surface area or base 35 which is adapted for supporting the container 10 in a generally vertical orientation when the container 10 is placed on a flat horizontal surface. An open central region 32 is defined as the area between the rear panel 24, the top and bottom portions 14 and 16, and the second side sections 28*b*. The open central region 32 is generally elongated and enables consumers to have access to the lawn implement 18 without manipulating the container 10. The open central region 32, defined by rear panel 24, top and bottom portions 14 and 16, and second side sections 28*b*, provide large angled advertising spaces or billboard panels which are easily viewed by consumers as they approach the container 10.

The container 10 is formed from folding the blank 88 along a plurality of longitudinal fold or score lines 34 and a pair of transverse fold lines 36. Fastening cement or a similar adhesive compound is applied to the juncture between the rear panel 24 and the connecting panel 22. The second side sections 28*b* are then folded back toward the rear panel 24 into interlocking engagement to form an angle therebetween lying within a range of 60°-120°. The second side sections 28*b* interlock because one of the second side sections 28*b* has at least one tab 38 and the other second side section 28*b* has a corresponding cutout 40 adapted to receive the tab 38. In this embodiment, there are three tabs 38 which are seated within three cutouts 40. Prior to closing the flaps 30, an upper retainer 42 (shown in FIGS. 1 and 2) is inserted into the top portion 14. A lower retainer 44 is inserted into the bottom portion 16.

Figure 2:
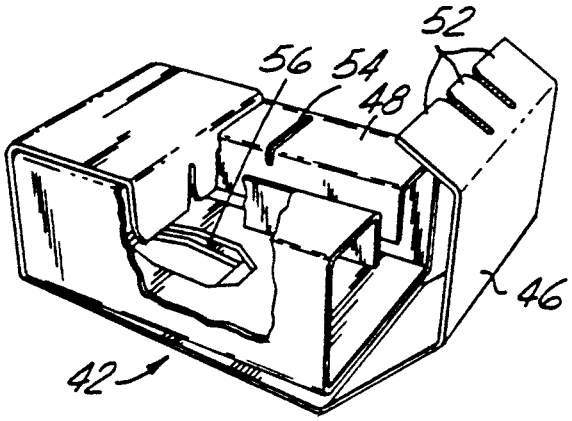
FIG. 2 is a perspective view partially broken away of the top retaining means having one tab disengaged.
Figure 5:
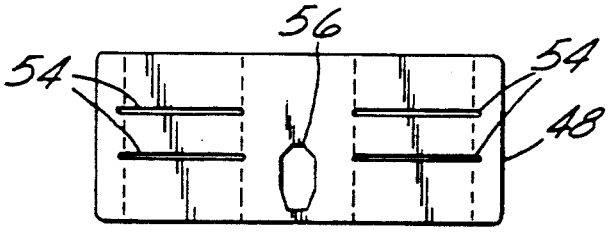
FIG. 5 is a plan view similar to that shown in FIG. 4 of a second blank utilized to form the top retaining means.
Figure 6:
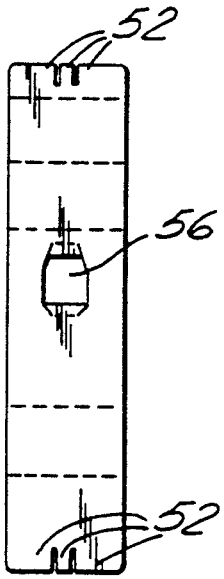
FIG. 6 is a plan view of a third blank which cooperates with the blank shown in FIG. 5 to form the top retaining means shown in FIG. 2.
Figure 8:
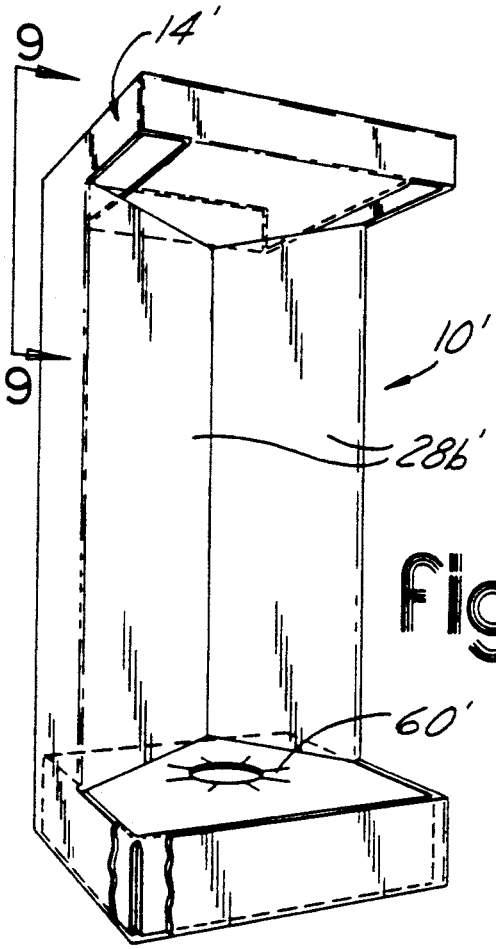
FIG. 8 is a perspective view partially cutaway showing a shipping and display container for an accessory to the lawn implement shown in FIG. 1.
Figure 9:
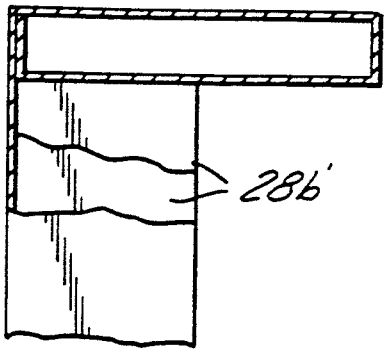
FIG. 9 is a side view, partially cutaway, taken along line 9—9 of FIG. 8.
Figure 11:
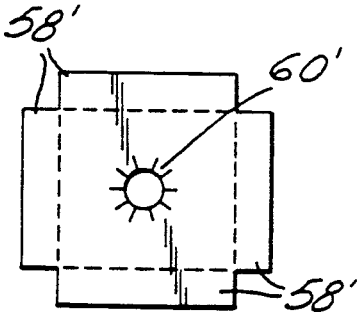
FIG. 11 is a plan view of the blank utilized to form the bottom retaining means shown in FIG. 8.

As best shown in FIGS. 2, 5 and 6, the upper retainer 42 is formed from a first member 46 and a second member 48. The first member 46 is a generally rectangular piece of cardboard or the like having a plurality of transverse fold lines 50 and a pair of longitudinal cuts 51 to form tabs 52 at each end of the first member 46. The second member 48, shown in FIG. 5 is also rectangular in shape and has a plurality of transverse fold lines bisected by a pair of longitudinal slots 54 adapted to receive the tabs 52. The first member 46 and second member 48 are each folded along their respective fold lines such that the first member 46 is folded around the second member 48 and tabs 52 are inserted into slots 54 to form a complete unit. A cutout 56 is centrally located within each of the first and second members 46 and 48 such that when combined to form the upper retainer 42, the cutouts 56 adapt to removably receive and retain the upper end 20 of the lawn implement 18. The upper retainer 42 is placed within the top portion 14 such that the cutout 56 is facing the open central region 32 of the container 10. The upper retainer 42 is prevented from falling into the open central region 32 by upper ends of the second side sections 28*b* which are in interlocking relation.

Figure 3:
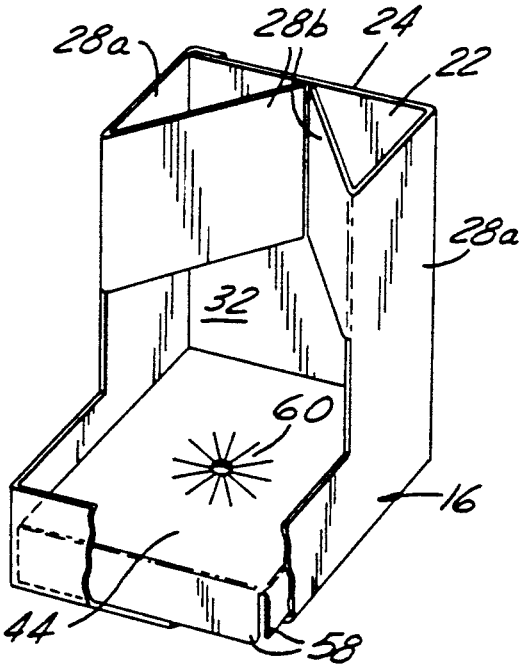
FIG. 3 is a perspective view taken along line 3—3 of FIG. 2 showing the second insert in accordance with the present invention.
Figure 7:
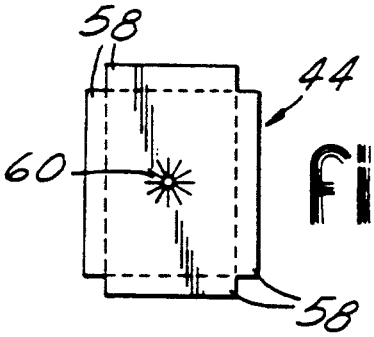
FIG. 7 is a plan view of a blank utilized in retaining the implement portion of the lawn implement.

The lower retainer 44, best shown in FIGS. 3 and 7, is a generally square shaped piece of cardboard or the like. A pair of transverse fold lines and a pair of longitudinal fold lines are located so as to provide flanges 58 which surround the lower retainer and provide a base upon which the lower retainer 44 rests in the bottom portion 16 (shown in FIG. 3). A plurality of radial slots defining a series of cantilevered retainers 60 are centrally located within the lower retainer 44 for removably receiving and retaining the implement end 21 of the lawn implement 10.

Figure 12:
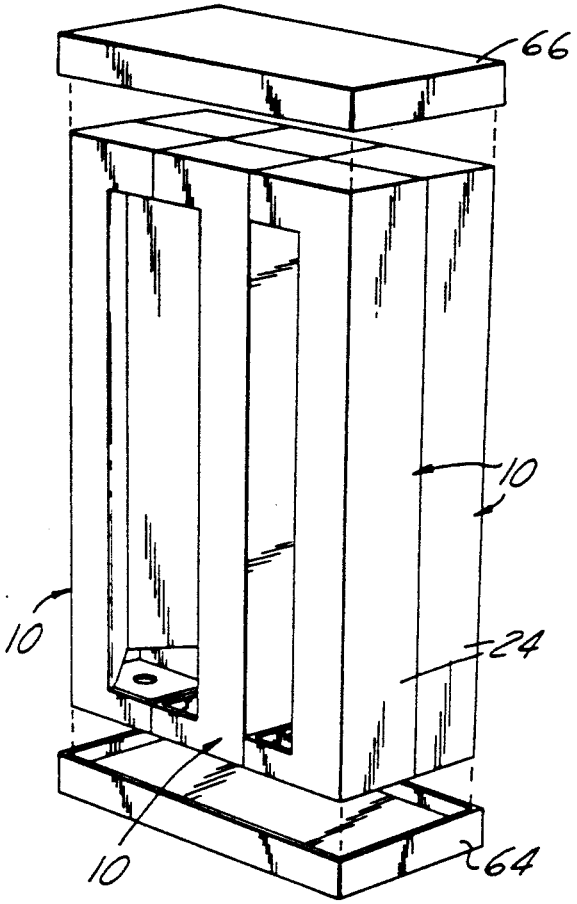
FIG. 12 is a perspective view partially exploded showing the formation of a shipping unit in accordance with the present invention.
Figure 13:
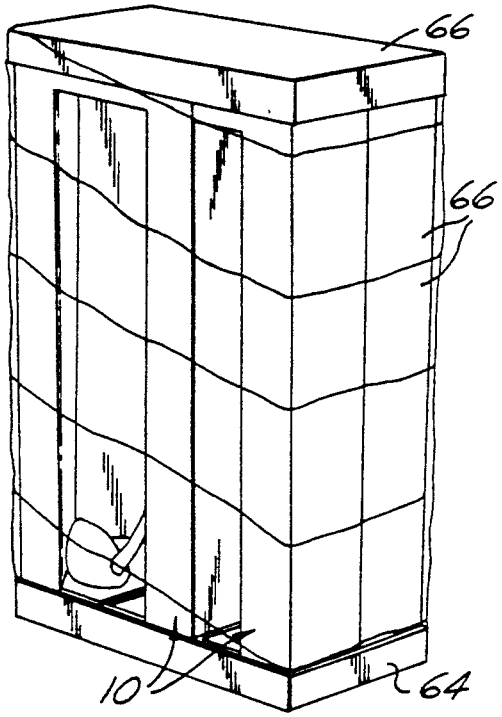
FIG. 13 is a perspective view similar to that shown in FIG. 12 illustrating a completed shipping unit wrapped in plastic.

FIGS. 12 and 13 illustrate a system for shipping a plurality of the elongated lawn implements 18 within the shipping and display containers 10. A base 64 is generally rectangular in shape and is adapted to receive a plurality of containers 10 in a generally vertical orientation. The containers 10 are placed within the base 64 such that at least two of the plurality of containers 10 are oriented face to face thereby exposing two rear panels 24. In this embodiment, six containers 10 are placed within the base 64 such that at each corner of the base 64 rear panels 24 are exposed. The cross sectional shape of the container 10 (as shown in FIG. 3) illustrates two closed triangular tubes, which in conjunction with the lawn implement 18, provide the container 10 with a rigid structure. The rear panels 24 of the containers 10 are exposed at the corners of the base 64 to take advantage of this rigid construction.

A lid 66 is shaped similar to that of the base and sized to receive the same number of containers 10 as the base 64. The lid 66 is placed over the top portions 14 of the containers 10. Then a wrap 68, in this configuration a translucent wrap, is shrink fitted around the base 64, the lid 66, and the containers 10 to form a secure integral unit for shipping.

Figure 10:
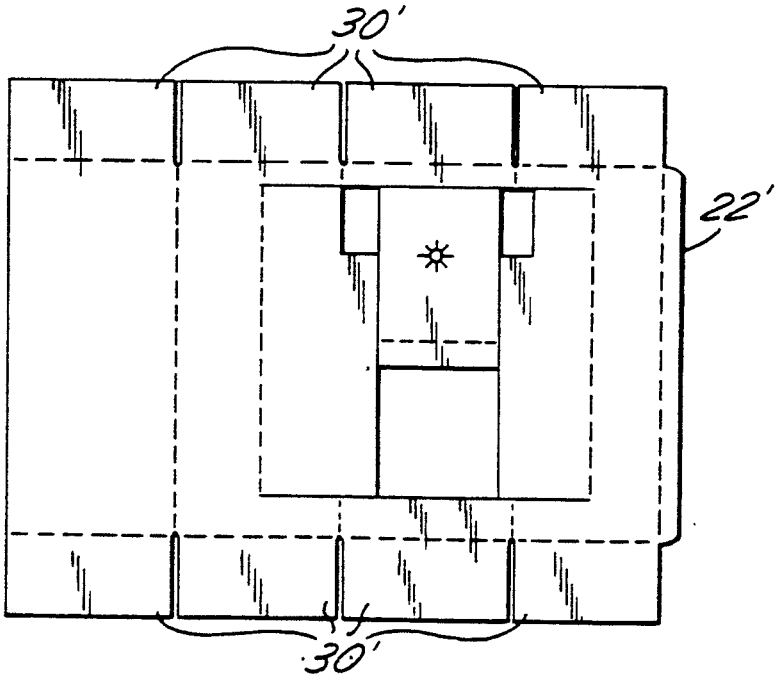
FIG. 10 is a plan view of the blank utilized to form the shipping and display container illustrated in FIG. 8.

The embodiment shown in FIGS. 8–11 illustrates a shipping and display container 10' for shipping elongated attachments 70 for the lawn implement 18. An elongated attachment 70 or working end is shown already attached within lawn implement 18 in FIG. 1. The general configuration, construction and function of this embodiment is similar to that shown in FIGS. 1–7. The numbers identified in FIGS. 8–11 have the same number corresponding to the embodiment shown in FIGS. 1–7 with the addition of a prime number to designate the alternative embodiment. One exception to the general construction is that the upper retainer 42' is integrally formed within the body portion 12' as shown in FIG. 10.

While the best mode for carrying out the invention has been described in detail, those familiar with the art to which this invention relates will recognize various alternative designs and embodiments for practicing the invention as defined by the following claims.

What is claimed is:

1. In a point-of-sale display and access arrangement including a tool having a motor, a driven working end remote from and driven by the motor, and a tubular shaft connecting the motor to the remote working end, the improvement comprising:

a C-shaped folded-up cardboard display carton having a first portion and a second portion and a body portion connecting the first and second portions, the first and second portions extending from the body portion to thereby define the C-shape;

the body portion having a rear panel and a pair of side panels which at least partially define an open channel, each side panel including a first side section and a second side section, the first side sections extending generally perpendicularly from the rear panel and the second side sections extending from the first side sections back toward the rear panel to enhance the structural rigidity of the body portion; and a first retainer and a second retainer located within the first and second portions, the motor of the tool extending into and being held by the first retainer and the working end extending into and being held by the second retainer;

wherein the arrangement may be oriented in an upright position with the second portion resting upon a horizontal surface and the first portion being maintained vertically thereabove so that the tool may be stably displayed with the motor being maintained vertically above the working end; and wherein the tubular shaft and at least a portion of the motor lie adjacent to the open channel between the first and second portions so that the at least a portion of the motor and the tubular shaft are displayed and are tactilely accessible at the point of sale and the arrangement of the carton and the tool can be carried in a generally horizontal fashion by using the tool as a handle.

2. The arrangement of claim 1 wherein:

the second portion has a base for resting upon the horizontal surface and the second retainer has a raised member spaced from the base having an aperture therein receiving the working end, the raised member cooperating with the second portion to enhance the structural rigidity of the carton.

3. A container for shipping and displaying a motor driven elongated lawn implement having an upper end and a lower end, the container comprising:

a body portion defining an elongated cavity having an open central region adapted for receiving a motor driven elongated lawn implement in an upright orientation, the body portion having a rear panel and a pair of side panels, each side panel having a first side section and a second side section, the first side sections extending generally perpendicular from the rear panel and the second side sections integrally connected to the first side sections and folded toward the rear panel, the second side sections each having a vertical edge cooperating with at least one of the other panels forming the open central region to hold the second side sections rigidly in place;

a top portion contiguous with the side panels of the body portion, the top portion having a pair of side sections extending outwardly from the rear panel beyond the first side sections and a face section extending between and perpendicular to the side sections of the top portion and spaced from the rear panel;

a bottom portion contiguous with the side panels of the body portion and opposite the top portion, the bottom portion adapted for supporting the container in a generally vertical orientation when placed upon a flat horizontal surface;

a first retainer cooperating with the top portion adapted for removably retaining an upper end of a said lawn implement; and a second retainer cooperating with the bottom portion for removably retaining a lower end of a said lawn implement, the first retainer and the second retainer oriented relative to the central open region to allow a said lawn implement to be displayed at the point of sale in a vertical orientation so as to locate the upper end of the lawn implement above the lower end and to allow the container to be carried by utilizing the lawn implement as a handle;

wherein the panels forming the body portion open central region are configured to be generally spaced from and to surround a said lawn implement when the lawn implement is held within the container thereby providing visible display surfaces for advertising graphics to attract consumer attention.

4. The container of claim 3 wherein:

the second retainer at least partially abuttingly resides within the bottom portion of the carton to reinforce and provide additional structural rigidity to the container.

5. The container of claim 3 wherein:

at least one of the first side sections, one of the second side sections and the rear panel cooperate with one another to define a closed section to increase the rigidity of the body portion.

6. The container of claim 5 wherein:

the closed section is triangular in cross-section.

7. The container of claim 3 wherein:

the second side sections are interconnected with one another and define an angle of between 60°–120° therebetween to provide display surfaces which are visible from the front of the display carton.

8. The container of claim 3 wherein:

at least one of the second side panels engages with the rear panel.

9. The container of claim 3 wherein:

at least one of the vertical edges has a tab thereon and one of the other panels forming the open central region has a slot therein so that the tab may be inserted into the slot to hold the tab and its second side section in fixed relation with respect to the rear panel.

10. A system for shipping a plurality of elongated motor driven lawn implements having upper and lower ends, the system comprising:

a plurality of shipping containers, each container including:

a body portion defining an elongated cavity having an open central region adapted for receiving a lawn implement in an upright orientation, the body portion having a rear panel and a pair of side panels, each side panel having a first side section and a second side section, the first side sections extending generally perpendicular to the rear panel and the second side sections integrally connected to the first side sections and folded toward the rear panel;

a top portion contiguous with the side panels of the body portion, the top portion having a pair of side sections extending outwardly from the rear panel beyond the first side sections and a face section extending between and perpendicular to the side sections of the top portion and spaced from the rear panel;

a bottom portion contiguous with the side panels of the body portion and opposite the top portion, the bottom portion adapted for supporting the container in a generally vertical orientation when placed upon a flat horizontal surface;

a first retainer in the top portion adapted for removably retaining an upper end of the lawn implement; and a second retainer in the bottom portion for removably retaining a lower end of the lawn implement, the first retainer and the second retainer cooperating with the central open region to allow the lawn implement to be displayed at the point of sale in a vertical orientation so as to locate the upper end of the lawn implement above the lower end and to allow an individual container to be carried by utilizing the lawn implement as a handle;

a rectangular base with four corners receiving the bottom portions of the plurality of shipping containers therein in a generally vertical orientation with at least two shipping containers oriented face-to-face with one another and with four of the rear panels of the containers respectively oriented adjacent the four corners of the base;

a lid receiving the top portions of the shipping containers therein; and a wrap substantially surrounding the lid, the base and the plurality of shipping containers to form an integral unit.

11. The system of claim 10 wherein:

each of the respective second side sections engage their rear panels in each respective container to increase the structural rigidity of the containers.

12. The system of claim 11 wherein:

each respective first and second side sections cooperate with their respective rear panel to form a closed section.

13. The system of claim 12 wherein:

closed sections of the containers are juxtaposed each corner of the base and lid to thereby provide enhanced strength to the integral unit.

14. In a point-of-sale display and access arrangement including a tool having a motor, a driven working end remote from and driven by the motor, and a tubular shaft connecting the motor to the remote working end, the improvement comprising:

a C-shaped folded-up cardboard display carton having a first portion and a second portion and a body portion connecting the first and second portions, the first and second portions extending respectively from the body portion to thereby define the C-shape;

the body portion having a rear panel and a pair of side panels which at least partially define an open channel; and a first retainer and a second retainer located respectively in the first and second portions, the motor of the tool extending into and being held by the first retainer and the working end extending into and being held by the second retainer;

wherein the arrangement may be oriented in an upright position with the second portion resting upon a horizontal surface and the first portion being maintained vertically thereabove so that the tool may be stably displayed with the motor being maintained vertically above the working end; and wherein the tubular shaft and at least a portion of the motor lie adjacent to the open channel between the first and second portions so that at least a portion of the motor and the tubular shaft are displayed and are tactilely accessible at the point of sale and the arrangement of the carton and the tool can be carried in a generally horizontal fashion by using the tool as a handle.

15. The arrangement of claim 14 wherein:

each side panel includes a first side section and second side section, the first side sections extending generally perpendicularly from the rear panel and the second side sections extending from the first side sections and back toward the rear panel, the second side sections each having a vertical edge cooperating with at least one of the other panels forming the open channel to hold the second side section in place.

16. The arrangement of claim 15 wherein:

at least one of the second side sections engages the rear panel to enhance the structural rigidity of the body portion.

17. The arrangement of claim 15 wherein:

the second side sections are in interlocking engagement with one another and engage the rear panel to enhance the structural rigidity of the body portion.

18. The arrangement of claim 17 wherein:

the second side sections define an angle of between 60°-120° therebetween to provide display surfaces which are visible from the front of the display carton.

19. The arrangement of claim 15 wherein:

at least one of the first side sections, one of the second side sections and the rear panel cooperate with one another to define a closed section to increase the structural rigidity of the body portion.

20. The arrangement of claim 19 wherein:

the closed section is triangular in cross-section.

* * * * *